United States Patent [19]

Kosikowski

[11] Patent Number: 4,787,805

[45] Date of Patent: Nov. 29, 1988

[54] DEVICE FOR THE INSERTION INTO AND REMOVAL FROM A SUSPENDED FRAME OF PARTS BEING GALVANIZED

[75] Inventor: Thomas Kosikowski, Nuremberg, Fed. Rep. of Germany

[73] Assignee: Schering Aktiengesellschaft, Berlin and Bergkamen, Fed. Rep. of Germany

[21] Appl. No.: 19,524

[22] Filed: Feb. 26, 1987

[30] Foreign Application Priority Data

Feb. 28, 1986 [DE] Fed. Rep. of Germany ..... 3606493

[51] Int. Cl.[4] ..... C25D 17/06; H05K 3/00

[52] U.S. Cl. ..... 414/416; 118/503; 294/2; 294/67.22; 414/226

[58] Field of Search ..... 414/403, 404, 416, 417, 414/623, 626, 627, 621, 225, 226; 427/433; 118/500, 503; 206/815; 294/2, 65, 67.22, 104; 220/22.1, 22.2, 22.3

[56] References Cited

U.S. PATENT DOCUMENTS

| | | | |
|---|---|---|---|
| 2,370,528 | 2/1945 | Fontaine | 294/104 X |
| 3,028,835 | 4/1962 | Rodriguez | 118/500 |
| 3,115,262 | 12/1963 | Avery | 414/627 X |
| 3,361,280 | 1/1968 | Traver | 294/65 X |
| 3,820,667 | 6/1974 | Critchlow et al. | 414/627 |
| 3,902,750 | 9/1975 | Roitel | 294/104 X |
| 4,062,166 | 12/1977 | Debaigt | 220/22.3 X |
| 4,678,169 | 7/1987 | Fishman et al. | 118/503 X |
| 4,681,213 | 7/1987 | Winiasz | 294/104 X |

*Primary Examiner*—Robert J. Spar
*Assistant Examiner*—David A. Bucci
*Attorney, Agent, or Firm*—Michael J. Striker

[57] ABSTRACT

A device for bringing plate-shaped objects to and removing said objects from a suspended frame, by means of which the objects are suspended in a galvanization bath, comprises pneumatically operated suction caps engaging the objects to be galvanized and a plurality of grippers engaging a respective plate-shaped object and applying to the object a force acting in a vertical direction to lift or lower said object. The suction cups engage side surfaces of the object and secure object against a lateral tilting motion.

9 Claims, 6 Drawing Sheets

DEVICE FOR THE INSERTION INTO AND REMOVAL FROM A SUSPENDED FRAME OF PARTS BEING GALVANIZED

BACKGROUND OF THE INVENTION

The present invention relates to a device for inserting into and removing from a suspended frame of parts to be galvanized.

Devices for inserting parts, particularly printed circuit boards, to be galvanized on a galvanizing bath into a suspended frame and removing those parts from the suspended frame have been known. The frame receiving parts being galvanized is usually suspending in the galvanization bath and the parts are connected to the frame in a suspended position. Such devices of the type under discussion include pneumatically-operated suction cups which apply a force to the parts to be galvanized to move the same. Forces exerted by such suction cups are however limited. Therefore, the field of application of such devices has been also limited. Such devices have been able to move only relatively small neat-shaped parts. Specific difficulties have occurred when the suspended frame had metallic masses deposited and "glued" thereon during the galvanization process, which masses require a sufficient pulling force to remove them from the suspended frame.

SUMMARY OF THE INVENTION

It is an object of the present invention to provide an improved device for inserting parts to be galvanized into a frame suspended in a galvanized bath.

It is another object of the invention to provide an improved device for inserting into a suspended frame printed circuit boards being galvanized which contain electronic circuits or later receive corresponding circuit elements.

Yet another object of the invention is to provide a device of the foregoing type, in which a necessary force for bringing plate-shaped parts into the suspended frame and removing these parts from the same as well as for placing the parts to all necessary positions will be provided.

These and other objects of the invention are attained by a device for bringing plate-shaped objects to and removing said objects from a suspended frame by means of which said objects are suspended in a galvanization bath, the device comprising pneumatically operated suction caps engaging the objects to be galvanized, wherein a plurality of grippers are provided, engaging a respective plate-shaped object and applying thereto a force acting in a vertical direction to lift or lower said object, said suction cups being engageable to either side surface of said object and securing said object against a lateral tilting motion; and a common lifting frame, said grippers and said suction cups being provided on said lifting frame.

The plurality of grippers provide a necessary force for lifting and lowering plate-shaped objects and eventually, for the tearing off, from the suspended frame after the completion of the galvanizing process of respective objects glued or baked to the frame.

The provision of the suction cups which prevent a tilting motion of the objects being galvanized ensures that these objects are held in the correct position or in balance which means that they are not laterally tilted during their lifting or lowering.

The provision of a common lifting frame with the grippers and suction cups positioned thereon ensures that the grippers and the suction cups are held in the same position relative to each other for transporting the plate-shaped objects. Thus not only the lowering and lifting of the objects being galvanized is obtained but also holding or balancing of these objects is ensured.

Inasmuch as the suction cups are engageable with the side surfaces of the objects, it is possible to move the objects without clearances or plays from below towards the objects that have been brought into the suspended frame before. Thus, undesired plays are avoided. Also, a play-less striking or attachment of the lateral vertical edges of the objects to be galvanized against the neighboring objects is possible.

Said suction cups may be positioned in an upper region of said lifting frame and said grippers may be positioned in a lower region of said frame. Thus the objects can be lifted from below with a respective pressure and laterally held in the upper region.

Each gripper may be spring-biased and may include two pear-shaped halves which taper to a point. This provides for a sufficient force transmission without requiring specific recesses perforations or the like to be provided in moveable plate-shaped objects for the insertion thereunto of the grippers.

Each gripper may have a supporting bar for supporting a lower edge of said object, said halves having this engaging said object at a lower region thereby, said engaging tips being positioned at a relatively small distance from said supporting bar so that a distance is ensured between the piece of engagement of the object with the grippers and the lower edge of the object supported on said bar. During the lifting of the object being galvanized its lower edge is supported so that the lifting of heavy plates is also possible.

The halves of each gripper may be each forced as a two-arm lever and are connected to each other at an end opposite to that carrying said tips, by a compression spring.

The device may further include a plunger provided with actuation means and positioned on said lifting frame, said plunger being moveable by said actuation means to pivot one of said gripper halves between a holding position in which said tips engage said object, and a release position.

Another one of said halves of the gripper may be stationary and is rigidly connected to said frame, said support bar being rigidly connected to said another one of said halves of the gripper.

The grippers may be spaced from each other and arranged along a horizontal line.

The suction cups may be also spaced from each other and be positioned at a distance from respective edges of an object being galvanized.

The device may include a supporting frame having guides for receiving a plurality of said plate-shaped objects, said supporting frame having below said guides a space for the insertion thereinto of said grippers to engage a respective one of said objects and laterally of said guides a space for applying to said objects of said suction cups.

The provision of the supporting frame enables supporting frame of the objects being galvanized when they have not been yet inserted into the suspended frame. On the other hand, the supporting frame is formed so that the guidance of the lifting frame with grippers and the suction cups is provided.

A plurality of fans may be formed on said supporting frame for accommodating said objects.

The suspended frame may include two parallel spaced elongated bars and a plurality of resilient clamping devices provided at each of said bars to engage elongated side edges of the objects being galvanized, said clamping devices freely extending from a respective bar and being positioned in a space between said bars and formed so that they enable an insertion into and a removal from said clamping devices of respective elongated side edges of the objects being galvanized by means of said suction cups.

The insertion of the edges of the plate-shaped objects between the resilient clamping devices of the suspended frame does not require a considerable force, which is advantageous.

Each of said objects may be each provided with at least one hole, and further including at least one supporting element insertable into said hole to hold said object in a clamping position, and means for moving said objects with said lifting frame transversely to a plane of each object.

The device may further include means for controlling motions of said lifting frame and for controlling loading and unloading of said suspended frame.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE EXEMPLIFIED EMBODIMENTS

Figure 1:
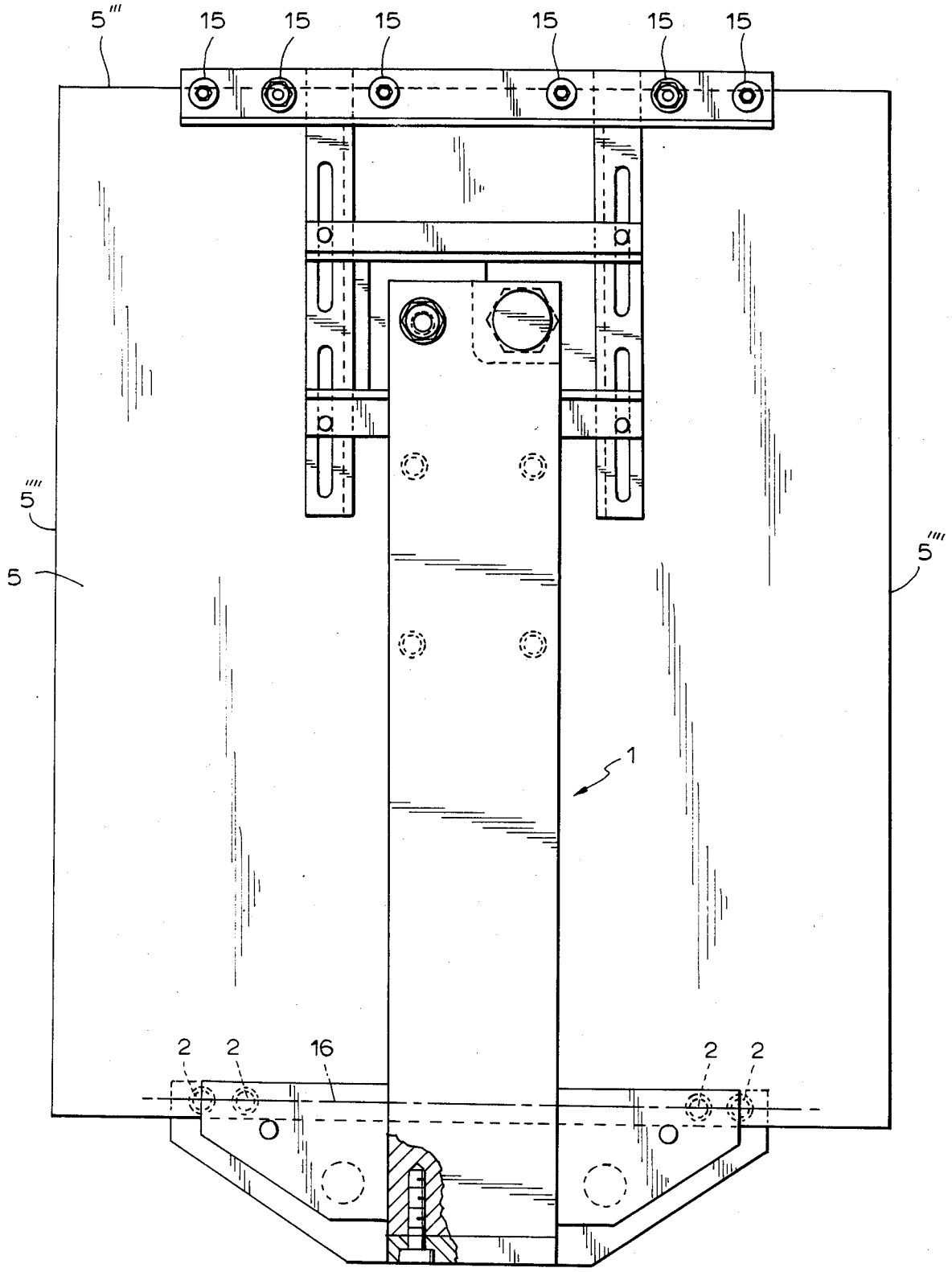
FIG. 1 is a front view of a lifting frame according to the invention.
Figure 2:
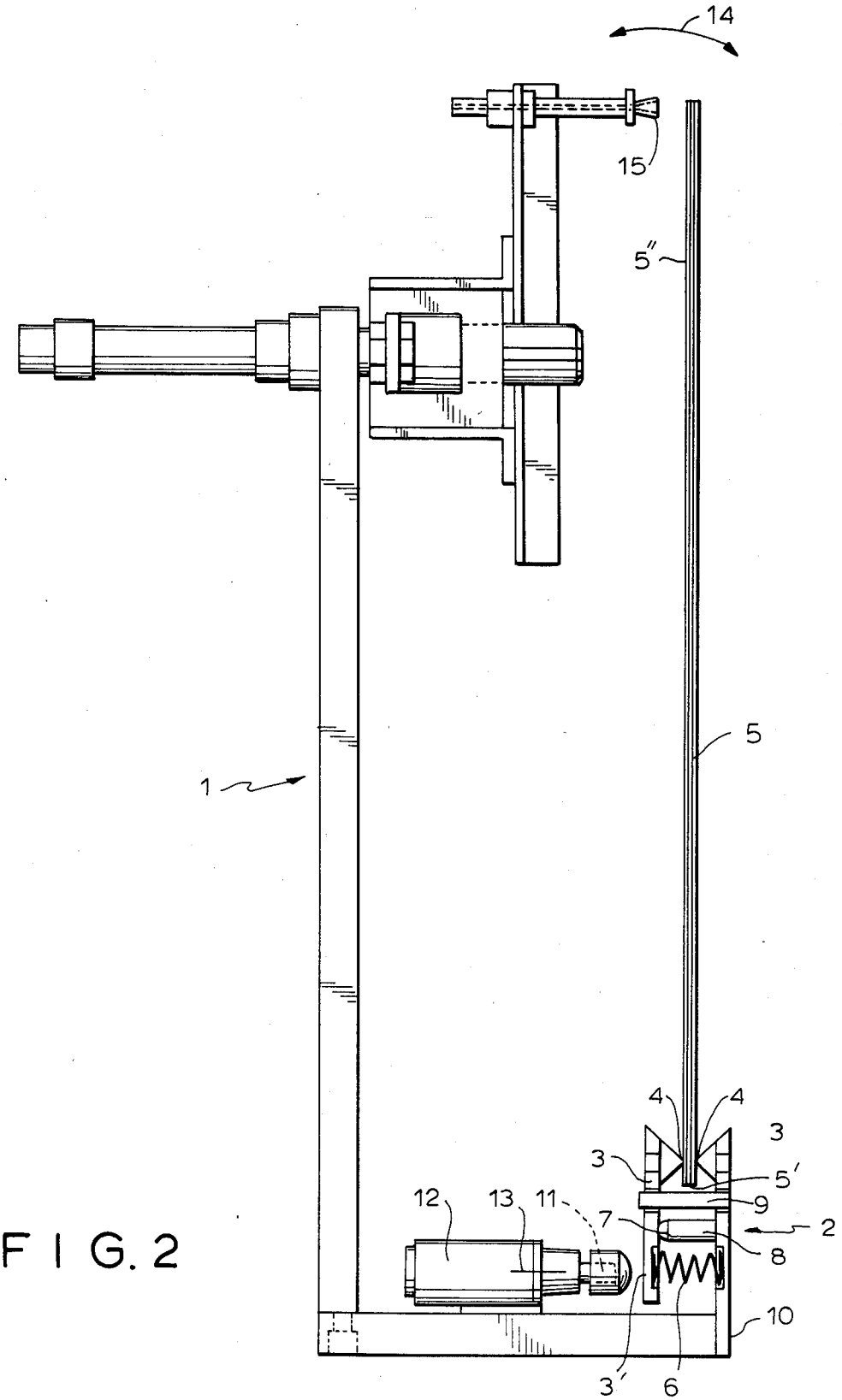
FIG. 2 is a side view of the lifting frame of FIG. 1.

Referring now to the drawings in detail, and firstly to FIGS. 1 and 2 thereof, these figures illustrate a lifting frame 1 which includes a number of grippers 2 positioned at the lower region of this frame. Grippers 2 are formed of two clamp-shaped or plier-shaped halves 3 which are adapted to grip in the lower region of the frame, with their gripping surfaces or gripping tips 4, a plate-shape part or item 5 being transported. Gripping tips 4 taper to a point as shown in FIG. 2. The grippers 2 further include a spring 6 which is prestressed. Thereby the left-hand half 3 of the pliers in FIG. 2 is pivotable about a pivot 7 of a pin-shaped bearing 8. A supporting bar or trunion a which is positioned at a relatively small distance from the gripper tips 4 also belongs to the gripper and serves for the supporting of a lower edge 5′ of the plate-shaped or sheet-like part 5. The right-hand half 10 of the gripper including the bar 9 is rigidly supported in the lifting frame and transmits its lifting force via the supporting bar 9, which supports the lower edge of plate-shaped object 5, and the gripper tips 4 to the plate-shaped part 5.

A plunger 11, which can be moved in the direction of arrow 13 by an element 12 which can be a magnet, a pneumatic device or any other suitable conventional device, is positioned on the lifting frame 1. This plunger 11, upon engaging the lower lever arm 3′ of the left-hand moveable gripper half 3 offsets the holding or clamping force of the gripper tips 4 on the plate-shaped part 5. When, at the same time, a pneumatic action of the pneumatic supports, which will be described below, is cancelled which can be performed by a synchronously controlled means, for example a synchronously controlled pneumatics, the plate-shaped item 5 will be released from the lifting frame 1.

In the upper region of the lifting frame 1, are provided suction cups 15 which are operated under vacuum. The suction cups are operated to grip the side surface 5″ of the plate-shaped part 5 and thus balance the same, particularly against an undesired tilting motion in the direction of double arrow 14. The suction cups 15 are connected to grippers 2 by the lifting frame 1. That is the position of these structural components relative to each other is fixed.

FIG. 1 further shows that a plurality of grippers 2 can be positioned one after another at a distance from each other along a horizontal line 16. Suction cups 15 are also positioned in the upper region of the lifting frame at a distance from each other along a horizontal line. The suction cups 15 are spaced from the edge of a respective plate-shaped part 5 such a distance that the suction cups do not obstruct the effective operation of the device according to the invention.

As seen from the drawings the plate-shaped parts can with their lower and upper edges 5′ and 5″ and side edges 5′″′ strike against neighboring plate-shaped parts, which are eventually galvanized. This non-gap striking is very important because in the case of the presence of the distance between the edge of one plate-shaped part from the edge of the adjacent plate-shaped part in the galvanic both layers can be deposited in such a gap in the form of so-called "dog bones". Such sediments are disadvantageous because the thickness of the galvanic layers produced can be outside permitted tolerances.

The suction cups can have a relatively small diameter because they must exert only balancing or compensating forces but not lifting or lowering forces.

Figure 4:
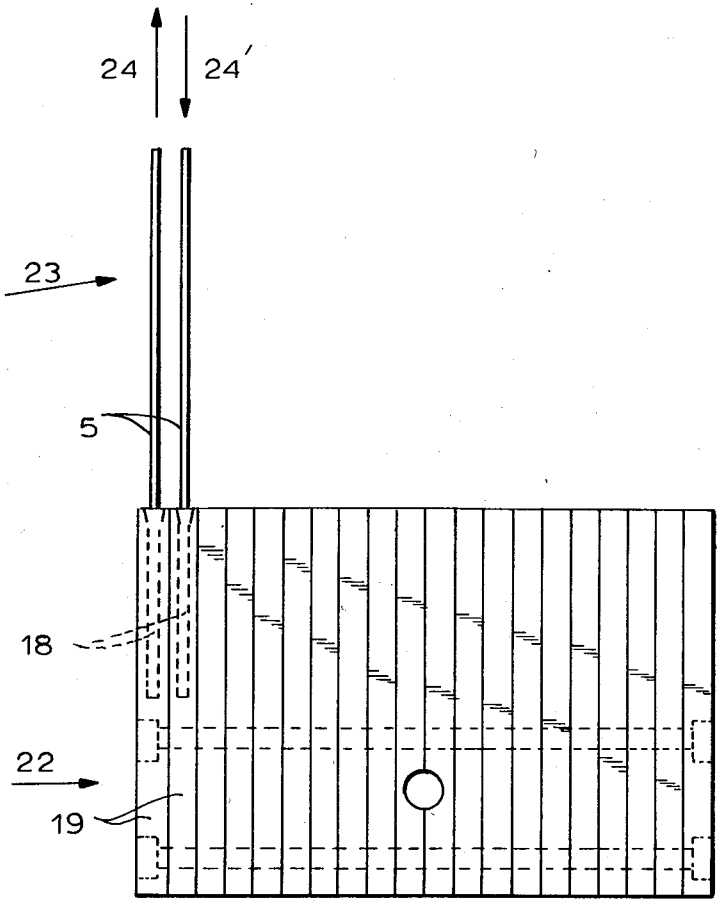
FIG. 4 is a side view of the supporting frame of FIG. 3.
Figure 3:
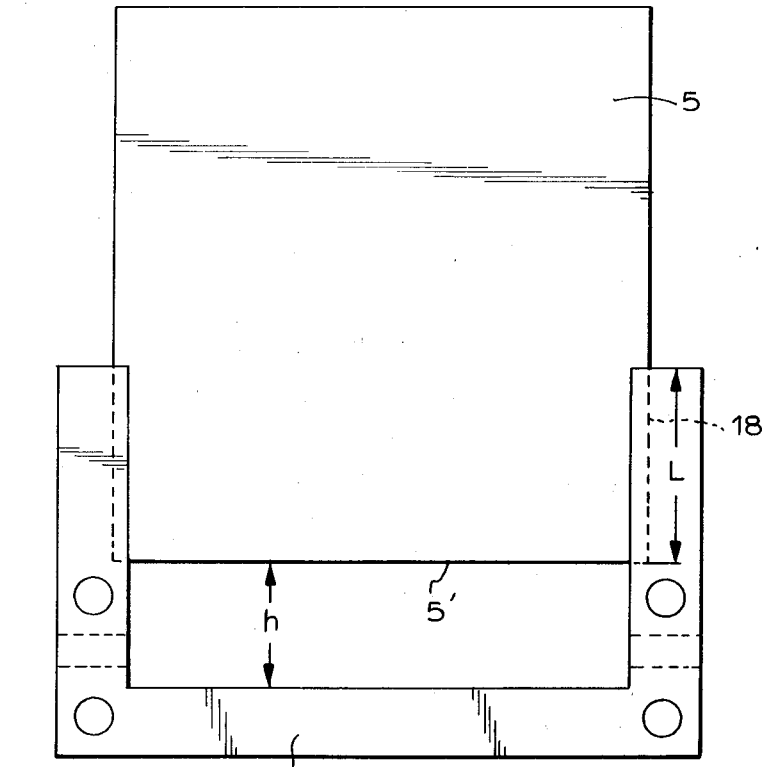
FIG. 3 is a front view of a supporting frame of the invention.

The reference numeral 17 designates a supporting frame shown in detail on FIGS. 3 and 4. The supporting frame has a row of slots 18 which extend over a limited distance L and can release a free space at the height h. The plate-shaped objects to be galvanized are denoted again by reference numeral 5. Slots 18 are so dimensional that the plate-shaped articles 5 are insertable thereunto. A row of fans 19 are provided inside the supporting frame 17 (20 fans in the exemplified embodiment). The plate-shaped objects 5 are accommodated one after another in those slots in a small space. The distance h between the lower edge 5′ of the article to be galvanized and a traverse 21 of the supporting frame 17 ensures the insertion of the grippers 2 in the direction of arrow 22 as shown in FIG. 4. Inasmuch as the length L of each slot 18 is limited a sufficient free space for applying of the suction cups in the direction of arrow 23 is available. As soon as the grippers and the suction cups are in the lifted position a respective plate-shaped part 5 is moved upwardly in the direction of arrow 24 and inserted into a respective suspended frame. The lowering position is identified by numeral 24'.

Figure 5:
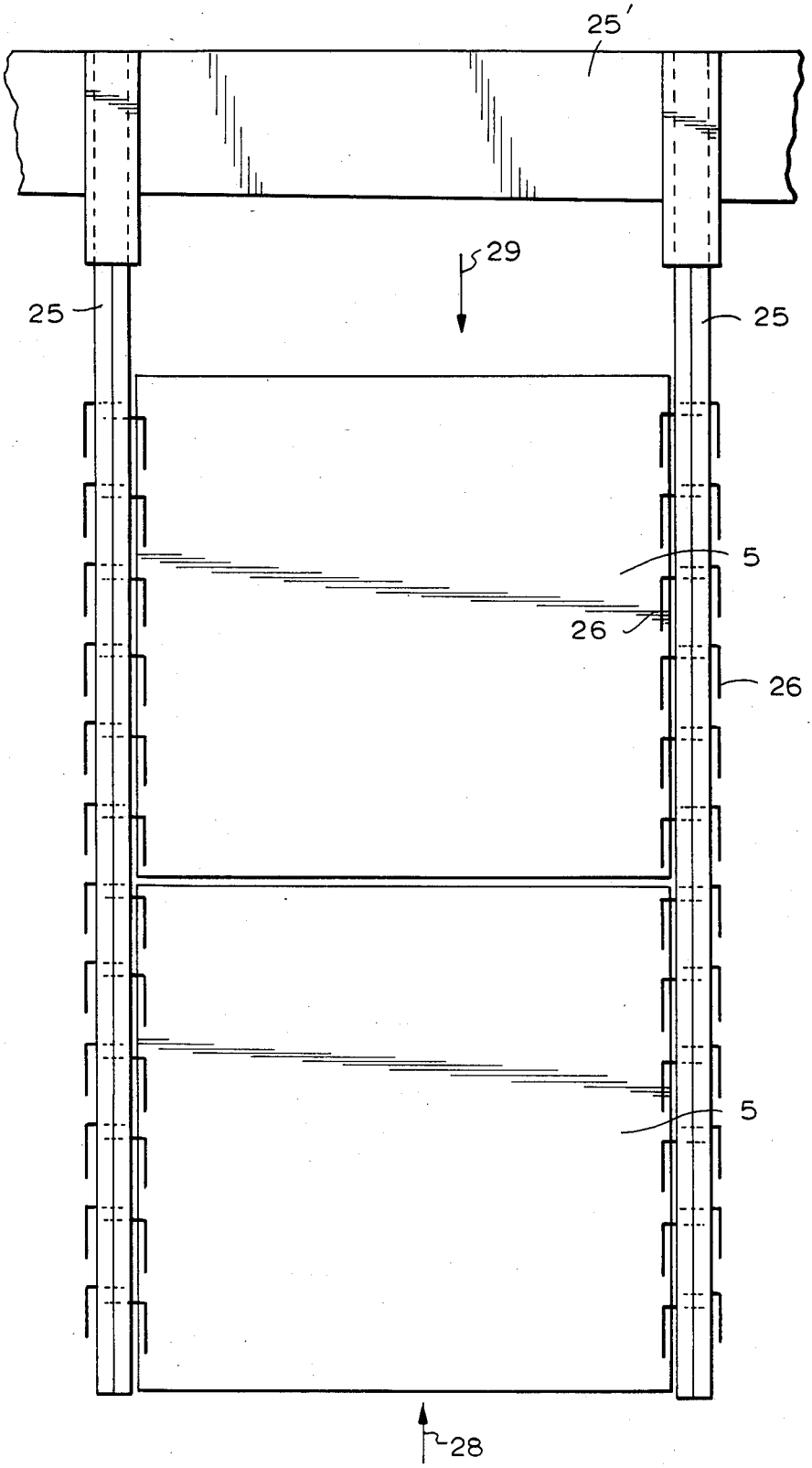
FIG. 5 is a front view of the exemplified embodiment of the invention.
Figure 6:
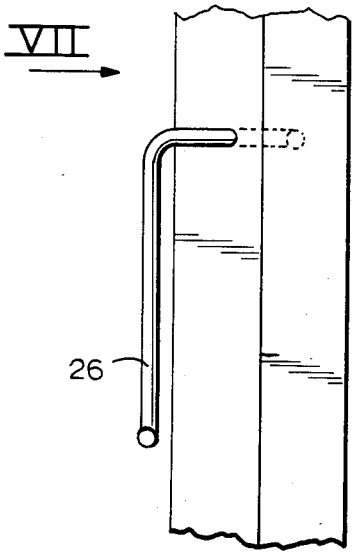
FIG. 6 is a detail of FIG. 5, on enlarged scale.
Figure 7:
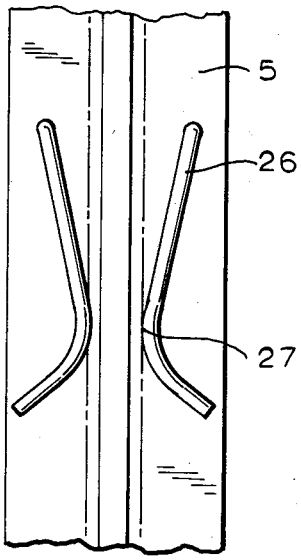
FIG. 7 is the view taken from arrow 7 of FIG. 6.

In the embodiment shown in FIGS. 5 to 7, the suspended frame of the invention is formed by two elongated bars 25 which support printed circuit boards 5. Pairs of clamping springs 26 cooperating with each other are provided at elongated bars 25. These springs can be slightly bent and thus hold the printed circuit board inserted therebetween at location 27 (FIG. 7) with a resilient clamping force. This is also schematically shown in FIG. 5. The shape of springs 26 is such that the printed circuit boards 5 can slide between the spring hairs counter to the direction of arrow 28 or in the direction of arrow 29, that is paralled to the elongated bars 25. The galvanizing flow is fed via the bars 25 and springs 26 to the printed circuit boards 5.

FIG. 5 further shows that springs 26 are spaced from bars 25, so that the bars do not obstruct the insertion of printed circuit boards 5. Respective springs advantageously extend into a space between both bars 25 so that a uniform galvanizing is obtained. Reference numeral 25' designates a traverse which connects both bars 25 to the suspended frame and is also identified as a supporting frame.

As can be also seen in FIG. 5 a plurality of printed circuit boards can be arranged in one frame, and also a plurality of printed circuit boards 5 can be provided in the horizontal direction because the elongated bars 25 can have at each side one row of superposed pairs of clamping springs.

As has been described above the device provided with the grippers and suction cups places a printed circuit boards at their edges between the clamping springs 26 to a clamping and thus galvanizing position and pulls these boards out from that position after the completion of the galvanizing process.

It is also possible to provide the printed circuit boards 5 at the edge 5' with one or a number of openings which will be engaged in the clamping or holding position by supporting elements of the respective bars of the frame and thereby the printed circuit boards will be additionally secured in the position in which they are galvanized.

Figure 9:
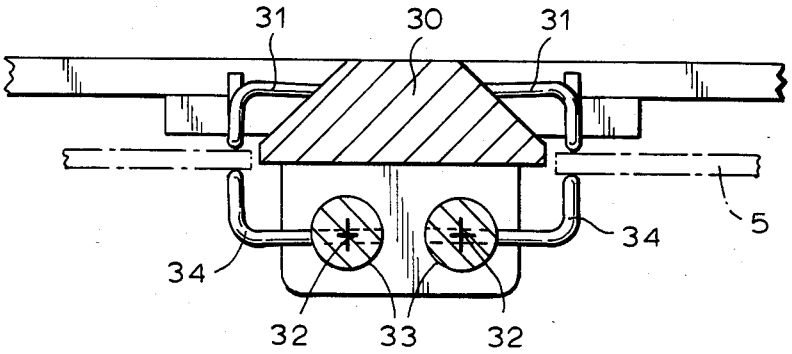
FIG. 9 is a sectional view taken along line 1x—1x of FIG. 8.
Figure 8:
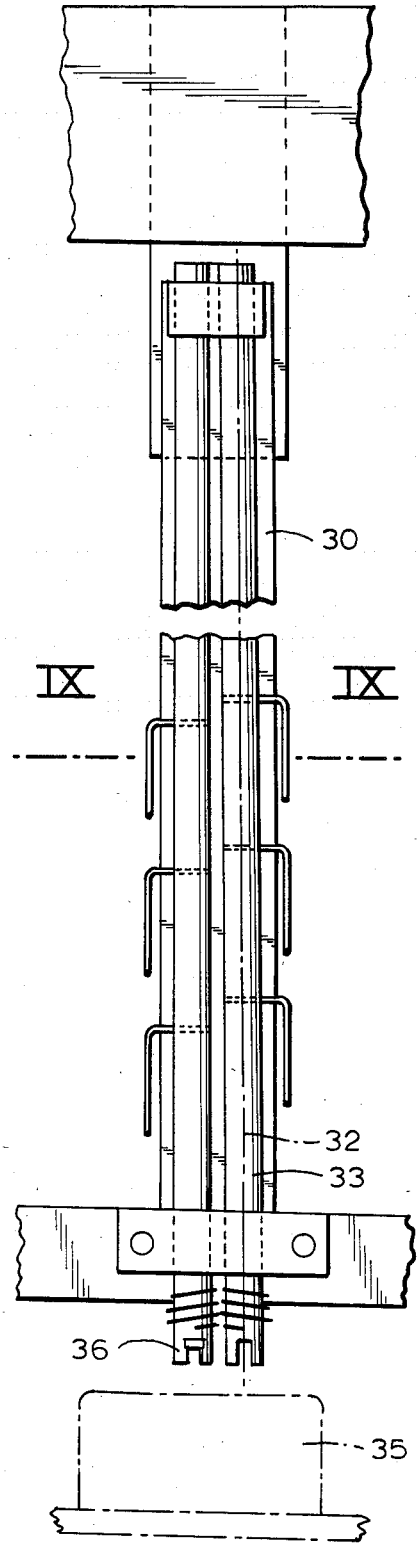
FIG. 8 is a front view of a modified embodiment of the invention.
Figure 8A:
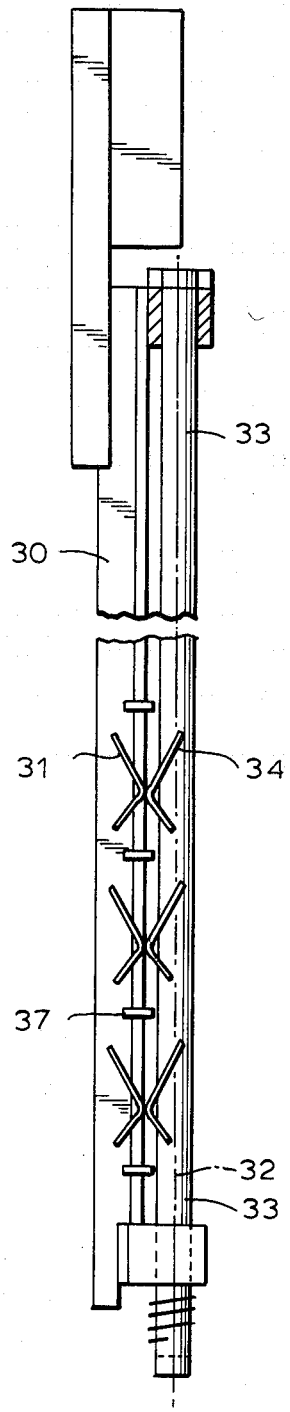
FIG. 8*a* is a side view of the device of FIG. 8.

The exemplified embodiment of the additional holding means is shown in FIGS. 8, 8*a* and 9. At the right-hand and left-hand sides of elongated frame bars 30 are provided spring pairs which are formed of springs 31 rigidly secured to the frame bars 30 and springs 34 cooperating with stationary springs 31 and pivotable about elongated axes 32 of shafts 33 together with the respective shafts. FIG. 9 shows spring pairs 31, 34 in the clamping position. The printed circuit boards 5 have at this point the position shown in dash-dotted line. By pivoting the left-hand shaft as viewed, the frame of FIG. 9 in the counterclock direction and the right-hand shaft in the clockwise direction springs 34 are moved from the clamping position and printed circuit boards 5 can be removed from the frame and new boards can be inserted in the galvanizing position. By rotating the left-hand shaft 33 in the clockwise direction and the right-hand shaft 33 in the counterclockwise direction the clamping position will be again obtained. This exemplified embodiment is particularly suitable for an automatic insertion of printed circuit boards into the clamping position and the repeated removal of the printed circuit boards from the frame of means of the above described device comprising grippers and suction cups because the transport of the printed circuit boards can be automatically coupled with a corresponding synchronous rotation of shafts 33. For this purpose a rotation magnet 35 (FIG. 8) can be provided, which drives one of the ends 36 of the shaft 33 so as to rotate the same in the aforedescribed manner about its axis 32. By means of two meshing gears the other shaft 33 can be rotated in the opposite direction.

As seen from FIGS. 8–9 holding or supporting pins 37 are connected to the frame. Boards or plates 5 are locked by means of these pins in the non-shown holes in the operation position, e.g. clamping position for galvanizing. Such locking or plug-in connection ensures that the printed circuit boards would not fall down during the assembling stages in which springs 31, 34 do not apply a clamping force to the printed circuit boards. The above mentioned holes can be in diameter greater than the diameter of the holding pins. Thereby the grippers can firstly pull respective printed circuit boards after the galvanization slightly downwards and thus release them from the fixed springs though the plates should be due to the galvanizing process "baked" to the springs. Then respective boards or plates 5 can be removed from the frame in the direction transversal to the board's plane without any problems.

Also, in the embodiment of FIGS. 8–9, the printed circuit boards can be moved by the grippers not upwardly but on the direction transverse to the plane of the printed circuit board. This has the advantage in the case when there is no space for the insertion of the printed circuit boards into the frame from above or from below. Such movement can be easily executed by means shown in FIGS. 1 and 2.

The above described springs can be made of round wire or flat wire (flat strip).

It will be understood that each of the elements described above, or two or more together, may also find a useful application in other types of devices for the insertion into and removal from a suspended frame of parts being galvanized differing from the types described above.

While the invention has been illustrated and described as embodied in a device for the insertion into and removal from a suspended frame of parts being galvanized, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A combination of a device for bringing plate-shaped objects to and removing said objects from a suspended frame, by means of which said objects are vertically suspended in a galvanization bath, with the suspended frame, comprising a plurality of pneumatically operated suction cups horizontally spaced from each other and engaging the objects to be galvanized; a plurality of grippers horizontally spaced from each other and engaging a respective plate-shaped object and applying thereto a force acting to lift or lower said object, said suction cups being engageable to either side surface of said object and securing said object against a lateral tilting motion; and a moveable common lifting frame, said grippers and said suction cups being provided on said lifting frame, said grippers being positioned at a lower end of said lifting frame whereas said suction cups being positioned at an upper end of said lifting frame, each gripper being spring-biased and including two pliers-shaped halves each including a tip tapering to a point at which each half of each gripper engages a side of the object being lifted, one of said halves of each gripper being stationary and rigidly connected to said lifting frame and another of said halves of each gripper being movable to bring said tapering tip thereof to engage the object or move said tip from the object to release the same, said stationary half carrying a supporting bar which supports a lower edge of said object, said suspended frame including two parallel spaced elongated bars and a plurality of resilient clamping devices provided at each of said bars to engage elongated side edges of the objects being galvanized, said clamping devices extending from a respective bar and being formed so that they enable an insertion into and a removal from said clamping devices of respective elongated side edges of the objects being galvanized.

2. A combination of a device for bringing plate-shaped objects to and removing said objects from a suspended frame, by means of which said objects are vertically suspended in a galvanization bath, with the suspended frame, comprising a plurality of pneumatically operated suction cups horizontally spaced from each other and engaging the objects to be galvanized; a plurality of grippers horizontally spaced from each other and engaging a respective plate-shape object and applying thereto a force acting to lift or lower said object, said suction cups being engageable to either side surface of said object and securing said object against a lateral tilting motion; and a moveable common lifting frame, said grippers and said suction cups being provided on said lifting frame, said grippers being positioned at a lower end of said lifting frame whereas said suction cups being positioned at an upper end of said lifting frame, each gripper being spring-biased and including two pliers-shaped halves each including a tip tapering to a point at which each half of each gripper engages a side of the object being lifted, one of said halves of each gripper being stationary and rigidly connected to said lifting frame and another of said halves of each gripper being movable to bring said tapering tip thereof to engage the object or move said tip from the object to release the same, said stationary half carrying a supporting bar which supports a lower edge of said object, said lifting frame with said grippers and said suction cups being operative to bring said objects to said suspended frame and to remove said objects from the latter.

3. The combination as defined in claim 2, further including a plunger provided with actuation means and positioned on said lifting frame, said plunger being movable by said actuation means to pivot said movable gripper half between said engaging position and said release position.

4. The combination as defined is claim 2, wherein said suction cups are positioned at a distance from a respective edge of each object lifted by said lifting frame.

5. The device as defined in claim 2, wherein said engaging tips are positioned at a relatively small distance from said supporting bar.

6. The device as defined in claim 2, wherein said halves of each gripper are connected to each other, at an end opposite to that carrying said tips, by a compression spring.

7. A combination of a device for bringing plate-shaped objects to and removing said objects from a suspended frame, by means of which said objects are vertically suspended in a galvanization bath, with the suspended frame, comprising a plurality of pneumatically operated suction cups horizontally spaced from each other and engaging the objects to be galvanized; a plurality of grippers horizontally spaced from each other and engaging a respective plate-shaped object and applying thereto a force acting to lift or lower said object, said suction cups being engageable to either side surface of said object and securing said object against a lateral tilting motion; and a movable common lifting frame, said grippers and said suction cups being provided on said lifting frame, said grippers being positioned at a lower end of said lifting frame whereas said suction cups being positioned at an upper end of said lifting frame, each gripper being spring-biased and including two pliers-shaped halves each including a tip tapering to a point at which each half of each gripper engages a side of the object being lifted, one of said halves of each gripper being stationary and rigidly connected to said lifting frame and another of said halves of each gripper being movable to bring said tapering tip thereof to engage the object or move said tip from the object to release the same, said stationary half carrying a supporting bar which supports a lower edge of said object, said suspended frame being a supporting frame including guides for receiving a plurality of said plate-shaped objects and having below said guides a space for the insertion thereinto of said grippers, and, laterally of said guides, a space for applying to said objects said suction cups of said lifting frame.

8. The combination as defined in claim 7, wherein a plurality of fans are formed in said supporting frame for accommodating said object.

9. The combination as defined on claim 7, wherein said guides are formed by slots.

* * * * *